US008771792B2

(12) United States Patent
Asai et al.

(10) Patent No.: US 8,771,792 B2
(45) Date of Patent: Jul. 8, 2014

(54) METHOD FOR MANUFACTURING LIQUID DISCHARGE HEAD

(75) Inventors: Kazuhiro Asai, Kawasaki (JP); Yoshinori Tagawa, Yokohama (JP); Satoshi Ibe, Yokohama (JP); Hiroyuki Murayama, Kawasaki (JP); Kouji Sasaki, Nagereyama (JP); Keiji Edamatsu, Fukushima (JP)

(73) Assignee: Canon Kabushiki Kaisha, Tokyo (JP)

( * ) Notice: Subject to any disclaimer, the term of this patent is extended or adjusted under 35 U.S.C. 154(b) by 786 days.

(21) Appl. No.: 13/013,144

(22) Filed: Jan. 25, 2011

(65) Prior Publication Data

US 2011/0195192 A1 Aug. 11, 2011

(30) Foreign Application Priority Data

Feb. 9, 2010 (JP) ..... 2010-026523

(51) Int. Cl.
*B41J 2/16* (2006.01)

(52) U.S. Cl.
USPC ..... 427/259; 427/258; 427/261; 427/264; 427/265; 427/270; 427/271; 427/272; 427/282; 29/890.09; 29/890.1; 347/44; 347/47; 347/54; 347/40

(58) Field of Classification Search
USPC ..... 29/890.09, 890.1
See application file for complete search history.

(56) References Cited

U.S. PATENT DOCUMENTS

| | | | | |
|---|---|---|---|---|
| 5,478,606 | A | 12/1995 | Ohkuma et al. | |
| 7,198,353 | B2 | 4/2007 | Hart et al. | |
| 7,862,155 | B2 | 1/2011 | Shibata et al. | |
| 2002/0041310 | A1 | 4/2002 | Kaneko et al. | |
| 2006/0001698 | A1 * | 1/2006 | Hart et al. | 347/40 |

FOREIGN PATENT DOCUMENTS

| | | | |
|---|---|---|---|
| JP | 2007-125810 | A | 5/2007 |

* cited by examiner

*Primary Examiner* — Michael Cleveland
*Assistant Examiner* — Lisha Jiang
(74) *Attorney, Agent, or Firm* — Fitzpatrick, Cella, Harper & Scinto

(57) ABSTRACT

Provided is a method for manufacturing a liquid discharge head, the liquid discharge head includes a substrate provided on a surface with a first energy generating part and a second energy generating part for generating energy utilized for discharging a liquid; a first discharge port provided corresponding to the first energy generating part so as to face the surface; a second discharge port provided corresponding to the second energy generating part so as to face the surface; a first wall member which has a wall of a first liquid flow path which communicates with the first discharge port; and a second wall member which has a wall of a second liquid flow path which communicates the second discharge port, wherein a distance between the second energy generating part and the second discharge port is greater than a distance between the first energy generating part and the first discharge port.

5 Claims, 3 Drawing Sheets

METHOD FOR MANUFACTURING LIQUID DISCHARGE HEAD

BACKGROUND OF THE INVENTION

1. Field of the Invention

The present invention relates to a method for manufacturing a liquid discharge head which discharges liquid droplets, and in particular, to a method for manufacturing an ink jet recording head which records on a recording medium by discharging ink droplets. More specifically, the present invention relates to a method for manufacturing an ink jet recording head in which nozzles that can discharge liquid droplets having multiple liquid droplet sizes are configured on the same substrate in order to perform high-speed and high-quality printing.

2. Description of the Related Art

Conventionally, as disclosed in U.S. Pat. No. 5,478,606, for example, a liquid discharge head is manufactured by the following steps. First, a soluble photosensitive resin is patterned into a liquid flow path mold on a substrate on which a discharge energy generating element is formed. Next, a photosensitive cover resin layer that will serve as a nozzle member is applied on the substrate so as to cover this mold pattern, and a liquid discharge port communicating with the mold pattern is formed on the cover resin layer. Subsequently, a liquid supply port is formed by etching so as to penetrate from the substrate back side, and the photosensitive resin used in the mold pattern is removed, to thereby manufacture the liquid discharge head. According to this manufacturing method, since a semiconductor photolithography method is used, micro-fabrication to form the liquid flow paths, discharge ports and the like very precisely can be achieved.

Here, examples of liquid discharge heads include heads that have a greater amount of ink storage by making a flow path distance between the discharge energy generating element and the discharge port longer, and heads that have a stable liquid droplet size by making a flow path distance between the discharge energy generating element and the discharge port shorter. Heads having a greater amount of ink storage can perform solid printing with large dots efficiently and quickly. Heads having a stable liquid droplet size can achieve higher quality.

Accordingly, to achieve both high speed and high quality, U.S. Patent Application Publication No. 2002/0041310 discloses a liquid discharge head in which different kinds of nozzles are formed on a single substrate in order to discharge ink droplets with different sizes. Furthermore, U.S. Pat. No. 7,198,353 discloses a liquid discharge head having orifice plates with different thicknesses on the same substrate. In addition, Japanese Patent Application Laid-Open No. 2007-125810 discloses a method for manufacturing a liquid discharge head having orifice plates with different thicknesses in order to discharge an ink in different amounts (or different droplet sizes) from the same ink supply port. In Japanese Patent Application Laid-Open No. 2007-125810, the liquid discharge head is manufactured by providing a difference of the film thickness between the orifice portions of a small liquid droplet nozzle and a large liquid droplet nozzle by forming a height adjustment member on the ink flow path pattern on the large liquid droplet nozzle side, and using a photolithography method.

Thus, in order for a liquid discharge head to provide the printing quality of small liquid droplet size while being capable of keeping the discharge amount of large liquid droplet size, it is effective to configure a liquid discharge head such that it has on the same substrate nozzles capable of discharging both large and small size liquid droplets.

However, when forming nozzles having different liquid droplet sizes on the same substrate, in terms of manufacturing method, it is difficult to simultaneously form the orifice plates for the small liquid droplet nozzles and the large liquid droplet nozzles. Conventionally, although a laminating method has been used, it is difficult to control the distortion and positional misalignment that occur during the laminating, which can result in that printing quality is not maintained.

Furthermore, in the method disclosed in Japanese Patent Application Laid-Open No. 2007-125810, it is difficult to control the thickness of the orifice plates for the small liquid droplet nozzles when the height of the height adjustment member is increased, so that the problem of being unable to maintain printing quality can arise.

SUMMARY OF THE INVENTION

Accordingly, it is an object of the present invention to provide a method by which a liquid discharge head having on the same substrate orifice plates with different thicknesses for discharging differently-sized liquid droplets can be easily manufactured.

An example of the invention is a method for manufacturing a liquid discharge head, the liquid discharge head including: a substrate which is provided on a surface with a first energy generating part and a second energy generating part for generating energy to be utilized for discharging a liquid; a first discharge port through which a liquid is discharged, said first discharge port being provided corresponding to said first energy generating part so as to face said surface; a second discharge port through which a liquid is discharged, said second discharge port being provided corresponding to said second energy generating part so as to face said surface; a first wall member which has a wall of a first flow path for a liquid which communicates with said first discharge port; and a second wall member which has a wall of a second flow path for a liquid which communicates said second discharge port, wherein a distance between said second energy generating part and said second discharge port is greater than a distance between said first energy generating part and said first discharge port, the method comprising: providing on said substrate a first mold for said first flow path and a second mold for said second flow path, said first mold corresponding to said first energy generating part, said second mold corresponding to said second energy generating part; providing a first cover layer to serve as said first wall member so as to cover at least said first mold; forming said first discharge port and a first portion of said second wall member by removing a part of said first cover layer; providing a second cover layer to serve as a second portion of said second wall member so as to cover said first portion and said second mold, and so that a distance between said surface and an upper surface of said second cover layer is longer than a distance between said surface and said first discharge port; forming said second discharge port by removing a part of a portion constituting said upper surface of said second cover layer; and forming said first flow path by removing said first mold and forming said second flow path by removing said second mold.

According to the present invention, a liquid discharge head having on the same substrate orifice plates with different thicknesses for discharging differently-sized liquid droplets can be easily manufactured.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

The present invention relates to a method for manufacturing a liquid discharge head, the head including a substrate having a discharge energy generating element which generates energy for discharging a liquid from a discharge port, and flow path walls which form on the substrate liquid flow paths that communicate with the discharge port.

Furthermore, the present invention relates to a method for manufacturing a liquid discharge head, the head discharging at least a first liquid droplet and a second liquid droplet having a larger size than the first liquid droplet.

The flow path walls include a first liquid droplet flow path wall which constitutes a first liquid flow path that communicates with a first discharge port for discharging the first liquid droplet, and a second liquid droplet flow path wall which constitutes a second liquid flow path that communicates with a second discharge port for discharging the second liquid droplet.

An ink jet recording head will now be described as an embodiment of the liquid discharge head. Although the following description will mainly be based on an ink jet recording head as an application example of the present invention, the applicable range of the present invention is not limited thereto. The present invention may also be applied to a liquid discharge head for biochip fabrication and electronic circuit printing applications. In addition to an ink jet recording head, examples of the liquid discharge head include a head for color filter manufacturing.

Embodiment 1

The present embodiment will now be described in more detail with reference to FIGS. 1A to 1F and FIGS. 2A and 2B. The present embodiment will be used to describe the present invention by giving an example of a liquid discharge head which discharges two types of liquid droplets, small liquid droplets and large liquid droplets. In the present embodiment, a first liquid droplet flow path wall will be referred to as "small liquid droplet flow path wall," a second liquid droplet flow path wall will be referred to as "large liquid droplet flow path wall," a first discharge port will be referred to as "small liquid droplet discharge port," and a second discharge port will be referred to as "large liquid droplet discharge port." Further, the present invention is not especially limited to the present embodiment.

Figure 3:
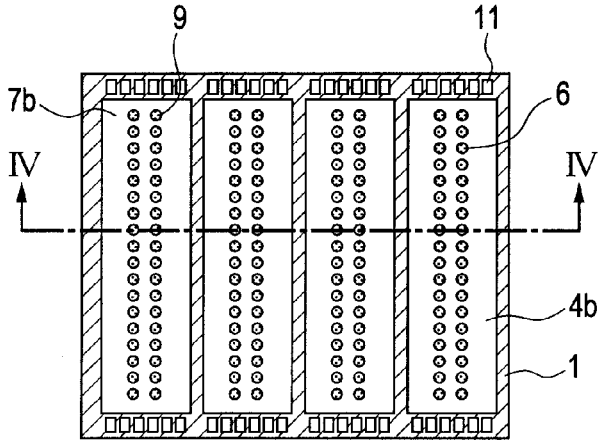
FIG. 3 is a top view illustrating an exemplary configuration of a liquid discharge head.
Figure 4:
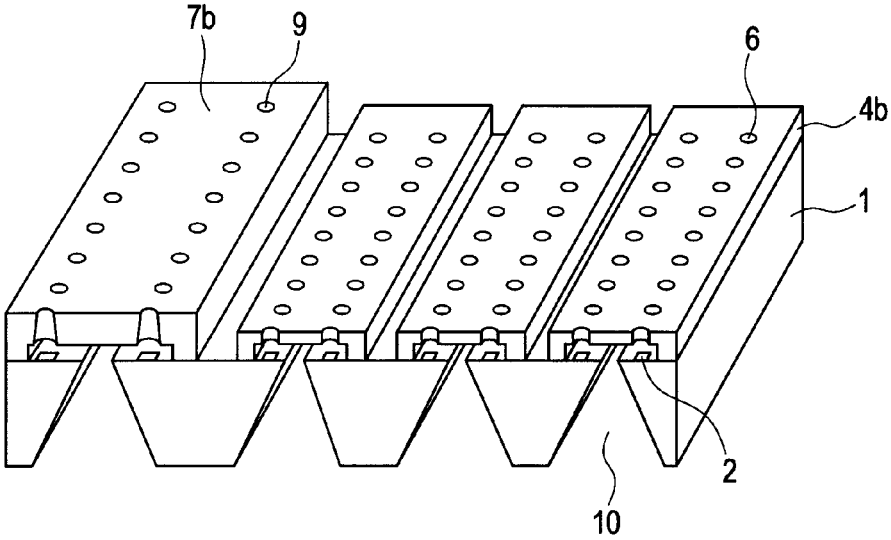
FIG. 4 is a schematic perspective view illustrating an exemplary configuration when the liquid discharge head illustrated in FIG. 3 is cut along the line IV-IV.

FIGS. 1A to 1F and FIGS. 2A and 2B are cross-sectional process diagrams illustrating the manufacturing method according to the present embodiment. FIG. 3 is a schematic top view illustrating the configuration of an upper surface of a liquid discharge head manufactured in accordance with the present embodiment. FIG. 4 is a schematic perspective view illustrating an exemplary configuration when the liquid discharge head illustrated in FIG. 3 is cut along the line IV-IV. As illustrated in FIG. 4, in the present invention, the small liquid droplet flow path wall has a smaller thickness than the thickness of the large liquid droplet flow path wall. A distance D2 between an energy generating element 2, which serves as an energy generating part provided on one surface of a substrate 1, and a second discharge port 9 is greater than a distance D1 between the energy generating element 2 and a first discharge port 6. For example, D1 is 15 to 30 μm, and D2 is 35 to 80 μm.

Figure 1A:
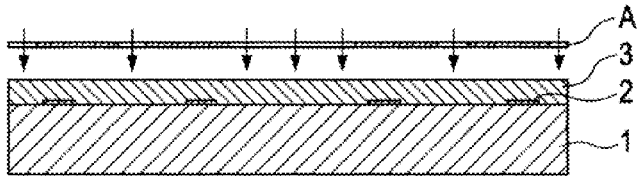
FIGS. 1A, 1B, 1C, 1D, 1E, and 1F are cross-sectional process diagrams illustrating an embodiment of a method for manufacturing a liquid discharge head according to the present invention.
Figure 1B:
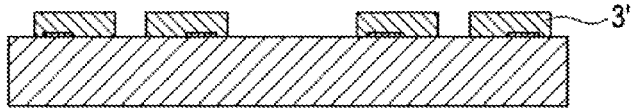

First, as illustrated in FIGS. 1A and 1B, an ink flow path pattern 3 is formed using a soluble resin on a substrate 1, which includes the discharge energy generating element 2 such as an electricity-heat transducing element or a piezoelectric element. An electricity-heat transducing element generates discharge energy by heating nearby ink liquid. A piezoelectric element generates discharge energy by, for example, mechanical oscillation. A control signal input electrode (not-illustrated) is connected to the discharge energy generating element 2 for operating the element. Further, to improve the durability of the discharge energy generating element, various functional layers, such as a protective layer, may be provided thereon.

The soluble resin that will form the ink flow path pattern 3 can be formed on the substrate 1 by a method such as spin coating or roll coating. The soluble resin may be applied to a thickness of, for example, 5 to 15 μm. This soluble resin is formed in the pattern of the ink flow paths by photolithography using a mask A.

It is preferred that the soluble resin be a photosensitive resin so that the patterning can be carried out while maintaining an accurate positional relationship with the discharge energy generating element 2. In the present embodiment, a positive type resist may be used, for example. More specifically, polymethyl isopropenyl ketone (PMIPK) with cyclohexanone as a solvent may be used.

Figure 1C:
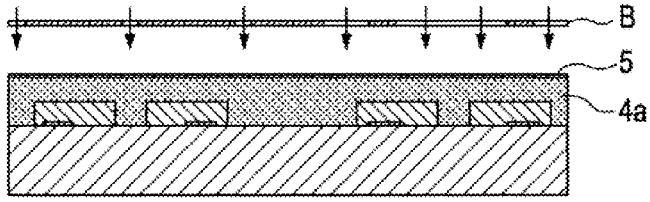

Next, as illustrated in FIG. 1C, a first cover resin 4*a* is formed on the ink flow path pattern 3. The first cover resin 4*a* is a material constituting the small liquid droplet flow path wall and the base of the large liquid droplet flow path wall.

The first cover resin 4*a* can be formed by a method such as spin coating or roll coating. The thickness of the first cover resin may be, for example, from 15 to 30 μm so that the ink flow path pattern is completely covered and so that an orifice plate having a discharge port portion can be formed.

When forming the first cover resin 4*a*, it is preferred to select a first cover resin that will not cause the ink flow path pattern 3 to deform. More specifically, as the solvent used for the first cover resin 4*a*, it is preferred to use a solvent that dissolves the cover resin but does not dissolve the ink flow path pattern. Further, it is preferred that the first cover resin 4*a* have high mechanical strength as a structural member of the ink flow paths, have adhesion with the substrate 1, and have ink resistance and the like. In addition, to accurately pattern a communication portion from the discharge energy generating element 2 to a discharge port, it is preferred that the first cover resin 4*a* be a photosensitive resist that can be formed by photolithography.

In the present embodiment, for example, a negative type photosensitive resin composition may be used as the first cover resin. More specifically, an epoxy resin composition represented by the following resin composition 1 may be used. This epoxy resin composition has photo-cationic polymerization properties, and such photo-cationically polymerized cured product has excellent strength, adhesion, and ink resistance, as well as having excellent patterning properties. In order to form the first cover resin by spin coating, the following composition 1 may be dissolved at a concentration of 60 wt. % in a mixed solvent of methyl isobutyl ketone/xylene.

Resin Composition 1

EHPE-3150 (trade name, manufactured by Daicel Chemical Industries, Ltd.); 100 parts by mass A-187 (trade name, manufactured by Nippon Unicar Company Limited); 5 parts by mass Adeka Optomer SP-172 (trade name, manufactured by Adeka Corporation); 6 parts by mass Additives and the like may be appropriately added as necessary to the above composition. For example, an agent that imparts flexibility may be added to lower the elastic modulus of the epoxy resin. Alternatively, a basic substance may be added to prevent compatibility with the soluble resin. Moreover, a silane coupling agent may be added to obtain an even stronger adhesive force with the substrate 1.

Furthermore, in the present embodiment, as illustrated in FIG. 1C, a water-repellent layer 5 that has liquid-repelling properties can also be formed on the first cover resin 4*a* to improve discharge stability. The water-repellent layer 5 can be patterned simultaneously with the first cover resin 4*a*. The water-repellent layer 5 can be formed using, for example, a curtain coating (slit coating) method using a liquid material, or using a method that laminates a dry film material.

Figure 1D:
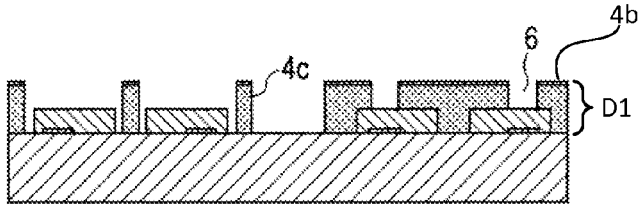
Figure 5:
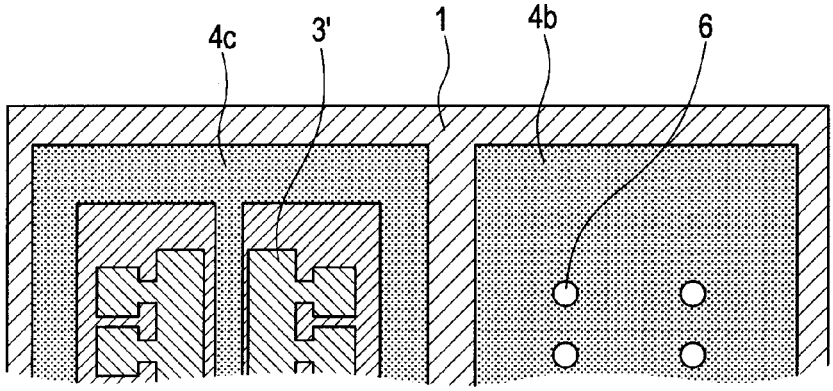
FIG. 5 is a schematic top view illustrating an example of the arrangement shape of a base of a large liquid droplet flow path wall in FIG. 1D.

Next, as illustrated in FIGS. 1C and 1D, the first cover resin 4*a* is patterned by photolithography using a mask B so that the small liquid droplet flow path wall and the base of the large liquid droplet flow path wall remain. More specifically, the base of the large liquid droplet flow path wall is formed at the same time as the small liquid droplet flow path wall is formed using the first cover resin. The base of the large liquid droplet flow path wall allows a second cover resin to be formed more evenly in the subsequent steps, and also allows the large liquid droplet flow path wall to be formed more evenly. As illustrated in FIG. 5, for example, a base 4*c* of the large liquid droplet flow path wall can be arranged so as to surround the large liquid droplet flow path. The grounding region of the base can be changed so as to be adjusted for the flow path pattern.

The base is formed so as to be enclosed in the second liquid droplet flow path wall.

Further, when forming the small liquid droplet flow path wall, the small liquid droplet discharge port 6 may be patterned and formed at the same time.

Figure 1E:
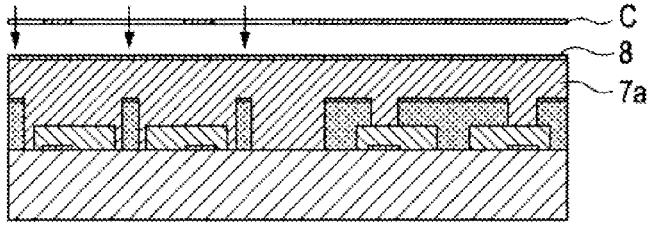

Next, as illustrated in FIG. 1E, a second cover resin 7*a* that will serve as the large liquid droplet flow path wall is formed on a small liquid droplet flow path wall 4*b* and the base 4*c*. Further, as illustrated in FIG. 1E, a second water-repellent layer 8 can be formed on the second cover resin 7*a*.

Here, the same material as the first cover resin 4*a* can be used for the second cover resin 7*a*, or a different material may be used. When using a different material from the first cover resin 4*a* for the second cover resin 7*a*, it is preferred that the second cover resin 7*a* have good adhesion with the first cover resin 4*a*, and have the properties required as a structural member of the above-described ink flow paths. The same material as the first water-repellent layer 5 can be used for the second water-repellent layer 8, or a different material may be used.

Even if a water-repellent layer is arranged on the small liquid droplet flow path wall, since the large liquid droplet flow path wall is formed so as to enclose the base of the large liquid droplet flow path wall, adhesion can be maintained at the side sections of the base. Consequently, a water-repellent layer can be provided on the surface of the small liquid droplet flow path wall, thus enabling the printing stability of the small liquid droplets to be improved.

The thickness of the second cover resin 7*a* (the distance from the substrate 1 surface to the resin layer surface) corresponds to the thickness of the large liquid droplet flow path wall, and is not especially limited as long as it is greater than the thickness of the first cover resin 4*a*. For example, this thickness may be 35 to 80 μm, and preferably 45 to 75 μm. The second cover resin 7*a* can be formed by splitting the coating process into a plurality of times.

Figure 1F:
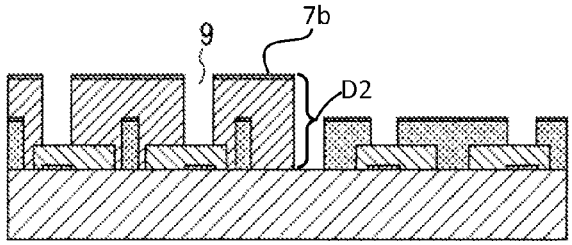

Next, as illustrated in FIGS. 1E and 1F, the second cover resin 7*a* is patterned by photolithography using a mask C to form the large liquid droplet flow path wall. The large liquid droplet flow path wall is formed on the substrate 1 other than in regions where the small liquid droplet flow path wall is formed. More specifically, the small liquid droplet flow path wall and the large liquid droplet flow path wall are formed in different regions on the substrate, respectively.

Further, at this stage the large liquid droplet discharge port 9 may be patterned and formed at the same time.

Figure 2A:
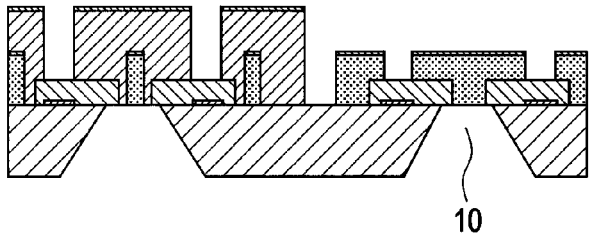
FIGS. 2A and 2B are cross-sectional process diagrams illustrating, following on from FIG. 1F, the embodiment of the method for manufacturing a liquid discharge head according to the present invention.

Next, as illustrated in FIG. 2A, an ink supply port (liquid supply port) 10, which serves as an opening portion for supplying an ink to the substrate 1, is formed. The ink supply port 10 can be formed, for example, by anisotropic etching of silicon by TMAH. At this stage, to prevent the water-repellent layers 5 and 8 and the flow path walls 4*b* and 7*b* from being damaged, the surface on the side where the nozzles on the silicon substrate are formed may be protected with a protective film made of cyclized rubber and the like.

Figure 2B:
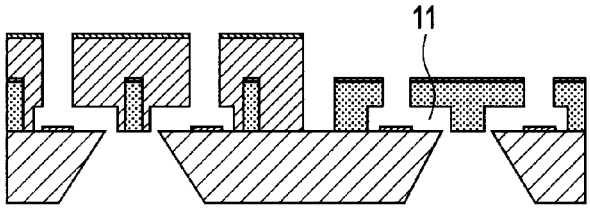

Next, as illustrated in FIG. 2B, the ink flow path pattern 3' is removed by dissolving with an appropriate solvent. The dissolution can be carried out by, for example, dipping the substrate in a solvent, or by spraying the solvent onto the substrate. The elution time can be shortened by also using ultrasonic waves and the like.

The thus-formed ink jet element is electrically joined (not-illustrated) so as to allow the member for supplying an ink and the discharge energy generating element 2 to be driven, thereby manufacturing an ink jet recording head.

According to the method described in the present embodiment, a liquid discharge head can be manufactured which can discharge a plurality of large liquid droplets and small liquid droplets supplied from respective single supply ports. When print recording of a test pattern was performed using the four colors of cyan, magenta, yellow, and black (Ink BCI-7, manufactured by Canon Inc.) with this liquid discharge head, an image having excellent gradation expression was obtained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-026523, filed Feb. 9, 2010, which is hereby incorporated by reference herein in its entirety.

What is claimed is:

1. A method for manufacturing a liquid discharge head, the liquid discharge head including: a substrate which is provided on a surface with a first energy generating part and a second energy generating part for generating energy to be utilized for discharging a liquid; a first discharge port through which a liquid is discharged, said first discharge port being provided corresponding to said first energy generating part so as to face said surface; a second discharge port through which a liquid is discharged, said second discharge port being provided corresponding to said second energy generating part so as to face said surface; a first wall member which has a wall of a first flow path for a liquid which communicates with said first discharge port; and a second wall member which has a wall of a second flow path for a liquid which communicates said second discharge port, wherein a distance between said second energy generating part and said second discharge port is greater than a distance between said first energy generating part and said first discharge port, the method comprising:

providing on said substrate a first mold for said first flow path and a second mold for said second flow path, said first mold corresponding to said first energy generating part, said second mold corresponding to said second energy generating part;

providing a first cover layer to serve as said first wall member so as to cover at least said first mold;

forming said first discharge port and a first portion of said second wall member by removing a part of said first cover layer;

providing a second cover layer to serve as a second portion of said second wall member so as to cover said first portion and said second mold, and so that a distance between said surface and an upper surface of said second cover layer is longer than a distance between said surface and said first discharge port;

forming said second discharge port by removing a part of a portion constituting said upper surface of said second cover layer; and forming said first flow path by removing said first mold and forming said second flow path by removing said second mold.

2. A method according to claim 1, comprising providing, after providing said first cover layer and before providing said second cover layer, a liquid-repellent layer including a liquid-repelling material so as to cover said first cover layer.

3. A method according to claim 2, comprising: providing a liquid-repellent layer including a liquid-repelling material so as to cover said first cover layer, forming said first portion of said second wall member having a liquid-repellent upper surface by removing the part of said first cover layer and a portion corresponding to said part of said first cover layer of said liquid-repellent layer, and providing said second cover layer so as to be in contact with a side surface of said first portion.

4. A method according to claim 1, wherein a distance between said first energy generating part and said first discharge port is 15 to 30 μm, and a distance between said second energy generating part and said second discharge port is 35 to 80 μm.

5. A method according to claim 1, wherein said first cover layer and said second cover layer are formed from a negative type photosensitive resin.

* * * * *